United States Patent [19]

Jones

[11] Patent Number: 4,768,457

[45] Date of Patent: Sep. 6, 1988

[54] INFLATABLE BOAT COVERS

[76] Inventor: Frederick L. Jones, 1777 SE. 15th St., Fort Lauderdale, Fla. 33316

[21] Appl. No.: 45,478

[22] Filed: May 4, 1987

[51] Int. Cl.[4] ..... B63B 17/00

[52] U.S. Cl. ..... 114/361

[58] Field of Search ..... 114/345, 357, 361, 219; 410/119; 296/100, 101

[56] References Cited

U.S. PATENT DOCUMENTS

| | | | |
|---|---|---|---|
| 2,468,287 | 4/1949 | Bohler | 114/345 |
| 2,764,950 | 10/1956 | Finnell | 410/119 |
| 2,907,580 | 10/1959 | Tietig | 410/119 |
| 3,021,536 | 2/1962 | Haggerty | 114/345 |
| 3,475,772 | 11/1969 | Lokken | 114/361 |
| 3,930,274 | 1/1976 | Syfritt | 114/345 |

FOREIGN PATENT DOCUMENTS

| | | | |
|---|---|---|---|
| 2334216 | 1/1975 | Fed. Rep. of Germany | 410/119 |

*Primary Examiner*—Joseph F. Peters, Jr.
*Assistant Examiner*—Stephen P. Avila
*Attorney, Agent, or Firm*—Alvin S. Blum

[57] ABSTRACT

A cover for covering an opening such as a cockpit, hatch and the like in a watercraft includes an inflatable chamber. When the cover is in place and the chamber inflated, the upper surface is convex in shape. This causes water and debris to run off the cover and prevents the pooling of water in the cover. The cover is of a flexible sheet material. When the chamber is deflated and the cover unfastened from the opening, it is as easily stored as are conventional covers.

19 Claims, 1 Drawing Sheet

INFLATABLE BOAT COVERS

FIELD OF THE INVENTION

This invention relates to covers for portions of boats including complete coverings for open boats, covers for open cockpits, hatches and the like, and more particularly to boat covers that include a bubble of gas to form a meniscus with a convex upper surface to prevent the pooling of water thereon.

BACKGROUND OF THE INVENTION

Various boat openings not provided with water-tight rigid covers may be provided with removable fabric coverings, generally secured with snaps to prevent entrance of water and debris. Because these coverings are flexible, they generally assume a concave upper surface under the force of gravity. If water strikes the upper surface, it will collect in the concavity, enlarging the concavity and forming a pool of water and debris, causing rot and premature failure. Furthermore, removing the cover with a pool of water is awkward. In the prior art, holders at the edge of the boat opening have been fitted for holding arched battens to give the cover a convex upper surface to prevent water pooling. Alternatively, rigid supporting framework, lines, and means for stretching the cover taut over the opening are employed.

U.S. Pat. No. 2,474,031 teaches an S-shaped spring in the opening forcing the cover to arch upward in the center to prevent water pooling. Structures of flexible sheet material formed by inflatable compartments are taught in U.S. Pat. Nos. 3,024,796; 3,116,746; 3,751,862; and 4,257,199.

SUMMARY OF THE INVENTION

This invention provides a boat cover with an inflatable pocket or chamber to form a convex upper surface when the cover is in place and the chamber is inflated. This forms a biconvex or meniscus-shaped bubble. The convex upper surface of the bubble causes water and debris to run off the surface, thereby preventing the pooling of water and debris that leads to rot and premature failure of the cover. It further eliminates the task of emptying the pool before the cover can be removed. Many large ships carry lifeboats. Each is stocked with survival supplies and covered. When covered with a flexible cover, a rigid framework may be included to arch the upper surface so that the cover will shed water. In the emergency of abandoning ship, time consumed in removing this framework may pose a safety hazard. The cover of the instant invention provides a water shedding upper surface without a framework and one that can be removed more rapidly in an emergency.

Conventional boat covers are made of natural or synthetic fiber woven fabrics that may be coated with water shedding material or they may be made of unwoven sheet material. They are fastened to the boat by snaps, grommets, zippers, lines, and the like. The covers of the instant invention may include the above materials of construction and fastening means. The inflatable chamber may be formed from a second layer of the covering material hermetically sealed at its periphery to the first layer. The chamber may be treated to make it impermeable to the inflating gas or the cover may be made of material that is intrinsically gas-impermeable. The chamber includes inflating and deflating means which may include a tubulation accessing the chamber and valve means for admitting or releasing gas in a first position and for sealing the chamber in a second position. Inflation may be from air compressors, gas tanks and the like. Inflation means, tubulations and valves are well known in the art of inflatable apparatus and will not be further described here.

In an alternative embodiment, the pocket formed from two layers of sheet material encloses an inflatable bladder connected to the inflating means. The bladder may be formed of a material selected for its gas containing properties without regard for its resistance to trauma since it is protected by the outer cover. And the outer cover need not have gas containing properties.

In yet another embodiment of the invention, the pocket is formed by a second layer of sheet material that is fastened at its periphery to a boat cover and the pocket encloses an inflatable bladder. This embodiment is especially useful for retrofitting existing boat covers.

The inflatable bladder may include anchoring members that also fasten at the periphery of the chamber to prevent shifting of the bladder.

The venting of gas may be through a separate connection to the gas chamber.

It is an object of the invention to provide a removable cover for a boat opening of a flexible sheet material that provides a convex upper surface for shedding water and debris, wherein the shape is formed by a gas bubble enclosed in a gas impermeable chamber that forms a part of the cover.

It is a further object to provide means to inflate the bubble with air or other gas to put the cover to use and to provide means to vent the gas from the bubble when the cover is not in use.

These and other objects and advantages of invention will become evident from the detailed description of preferred embodiments of the invention which follow.

BRIEF DESCRIPTION OF THE ILLUSTRATIONS

DETAILED DESCRIPTION OF PREFERRED EMBODIMENTS

Figure 1:
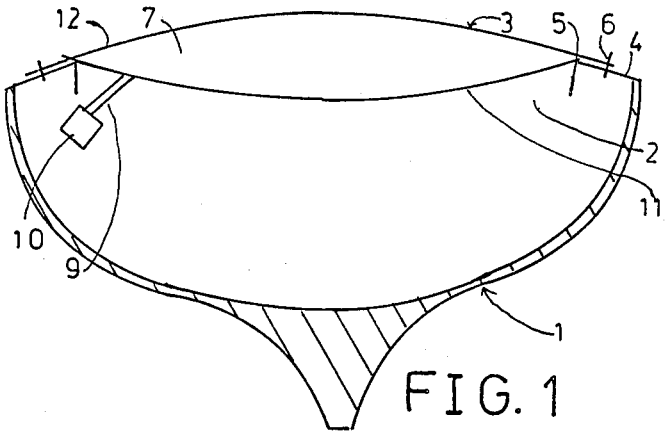
FIG. 1 is a cross sectional view of a sailboat with cover in place.

Referring first to FIG. 1, showing in cross section sailboat 1 with open cockpit 2 covered by the cover 3 of the invention in place covering the cockpit 2. The cover 3 is reversibly fastened to the upper deck 4 just outboard of the coaming 5 by fasteners such as snaps and grommets generally used for such purposes. The cover 3 has a chamber or pocket 7 that approximates in area the dimensions of the cockpit opening. The exact dimensions of the pocket are not critical. The pocket is shown in inflated condition. It is inflated by means of the connecting tube 9 and valve 10, generally to a low pressure sufficient to cause an upward bulge without excessive stress and providing for the expansion from the sun's heat. The inflated chamber 7 supported at its outer edge forms a generally meniscus or biconvex shape, with its lower surface 11 curving downward and its upper surface 12 curving upward. The upwardly curving upper surface causes water and debris to be washed overboard. It is useful to keep water out of a boat. It is also important to keep debris out of a boat because it can clog bilge pumps and lead to sinking as well.

Figure 2:
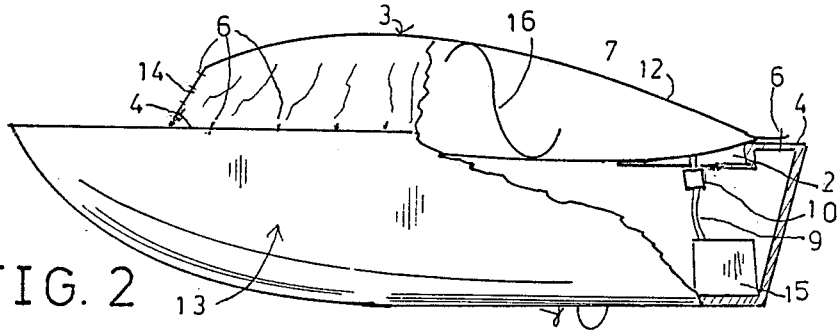
FIG. 2 is a side elevation view of a power cruiser with the cover over the cockpit and a portion broken away to show cover details.

FIG. 2 shows a power boat 13 with a cover 3 of the invention in place over the open cockpit 2, with a portion broken away to show details of the structure. The cover 3 is fastened by fasteners 6 to the windshield 14 and the upper deck 4. The chamber 7 is inflated by inflating means 15 via valve 10 and tube 9. Optional inner support 16, which is a strip of cover material, may be fastened at a first end to the top layer and at a second end to the bottom layer to control the shape of the inflated chamber at selected locations in a manner well known in the art of inflatable structures. The gas connection 9 and valve 10 may be made through the upper or lower surface of the chamber as desired.

Figure 3:
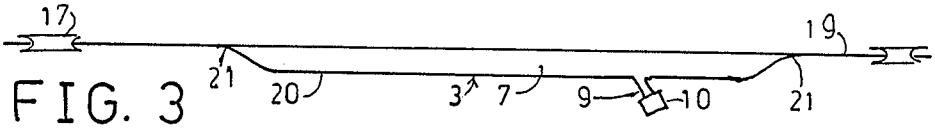
FIG. 3 is a cross sectional view of the cover with the gas chamber formed from the cover material.

FIG. 3 shows construction details of the cover 3 in cross section including: securing grommets 17 around the perimeter; a top layer 19 large enough to cover the opening in the watercraft; a bottom layer 20 sealed at its periphery 20 to the top layer 9 to form the packet therebetween. The material of construction may be a woven nylon fabric coated with a vinyl plastic sewn and heat sealed at the periphery 21 so as to be gas tight.

Figure 4:
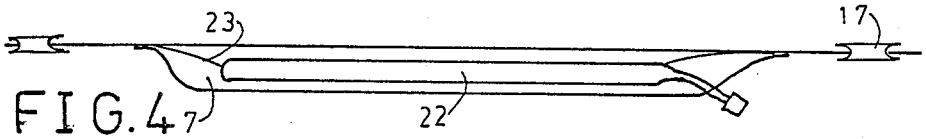
FIG. 4 is a cross sectional view of the cover with a separate gas bladder enclosed by cover material.

In the alternative embodiment of FIG. 4, a pocket 7 formed of two layers of cover fabric contains a separate gas bladder 22. This may have optional anchoring member 23 secured to the periphery to prevent shifting of the bladder in the pocket. The bladder 22 may be made of a material selected for its gas holding properties such as a sheet elastomer.

Figure 5:
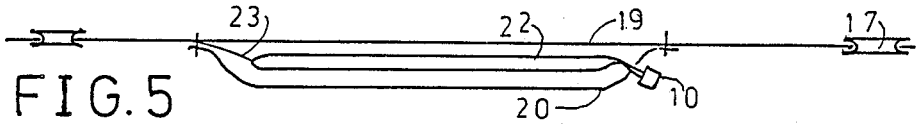
FIG. 5 is a cross sectional view of the cover with attachable chamber and separate gas bladder.

In the embodiment of FIG. 5, the bottom layer 20 of cover material is secured to the cover at its periphery by securing means 24 enclosing the gas bladder 22. The securing means may include zippers, hook and loop fasteners, snaps and grommets and other means well known in the art. This embodiment is especially useful in retrofitting existing boat covers by providing the water shedding bubble shape.

The above disclosed invention has a number of particular features which should preferably be employed in combination, although each is useful separately without departure from the scope of the invention. While I have shown and described the preferred embodiments of my invention, it will be understood that the invention may be embodied otherwise than an herein specifically illustrated or described, and that certain changes in the form and arrangement of parts and the specific manner of practicing the invention may be made within the underlying idea or principles of the invention within the scope of the appended claims.

I claim:

1. A removable, water-shedding boat cover for an opening on a watercraft such as a cockpit, a hatch and the like comprising:

a flexible top layer;

a flexible bottom layer;

a gas-containable chamber means including an envelope means formed by fastening together said top layer and said bottom layer at the perimeter of said chamber means;

gas inflating and deflating means connecting to said chamber means for inflating said chamber means with gas to form a rounded upper surface of sufficient size and shape to shed water and debris when covering said opening and for deflating said chamber means when cover is not in use for storage convenience;

and reversible fastening means connected to the outer edge of said cover, said fastening means adapted for fastening said cover to said watercraft, around said opening to prevent the accumulation and the entrance of water and debris.

2. In the invention of claim 1, said chamber means of substantially gas impermeable construction to retain said gas for prolonged periods of use in maintaining said rounded upper surface.

3. In the invention of claim 1, said chamber means further comprising a gas-impermeable bladder means enclosed within said envelope means, and said inflating and deflating means operatively connected to said bladder means.

4. The invention of claim 3, including anchor means connecting said bladder means to said chamber means to stabilize the position of said bladder means within said chamber means.

5. The invention of claim 3, including internal members within said bladder means to control the shape of said bladder means when inflated.

6. In the invention of claim 3, said bladder means of an elastomeric composition.

7. In the invention of claim 2, said chamber means including internal members connecting said top layer with said bottom layer to control the shape of said chamber means when inflated.

8. In the invention of claim 1, said bottom layer attachable at its perimeter to said top layer to form said chamber means with attaching means, said fastening means connected to the outer edge of said top layer.

9. In the invention of claim 8, said chamber means further comprising a gas-impermeable bladder means enclosed within said envelope means, and said inflating and deflating means operatively connected to said bladder means.

10. In the invention of claim 1, said top layer attachable at its perimeter to said bottom layer to form said chamber means with attaching means, said fastening means connecting to the outer edge of said bottom layer.

11. In the invention of claim 10, said chamber means further comprising a separate gas-impermeable bladder means enclosed within said envelope means, and said inflating and deflating means operatively connected to said bladder means.

12. A flexible boat cover with a pneumatically-formed, substantially convex upper surface for shedding water and debris when installed over an opening in a watercraft comprising:

a flexible, water-impermeable covering sheet of size and shape to cover said opening and extend at its perimeter beyond said opening;

fastening means connected to said sheet at said perimeter for reversibly fastening said sheet to said watercraft to cover said opening;

gas chamber means connected to said covering sheet, said chamber means of sufficient size and shape to form said convex upper surface over substantially all of said opening when said chamber means is inflated with gas;

gas inflating means connected to said chamber means for inflating said chamber with gas to form said convex upper surface; and gas deflating means to empty said chamber means of gas for improved storage of said cover when not in use.

13. In the invention of claim 12, said gas chamber means formed by an upper layer of gas-impermeable sheet material and a lower layer of gas-impermeable sheet material sealed together gas-tight at the periphery of said chamber means.

14. The invention of claim 12, said chamber means further comprising a separate gas-impermeable bladder means enclosed within said envelope means, and said inflating means and said deflating means operatively connected to said bladder means.

15. The invention of claim 14, including anchor means connecting said bladder means to said chamber means to stabilize the position of said bladder means within said chamber means.

16. The invention of claim 14, including internal members within said bladder means to control the shape of said bladder means when inflated.

17. In the invention of claim 14, said bladder means of an elastomeric composition.

18. In the invention of claim 13, said chamber means including internal members connecting said top layer with said bottom layer to control the shape of said chamber means when inflated.

19. In the invention of claim 12, said chamber means including an envelope means formed by a layer of flexible sheet material attachable at its perimeter to said covering sheet with attaching means, said envelope means enclosing a gas-impermeable bladder means within said envelope means, and said inflating means and said deflating means operatively connected to said bladder means.

* * * * *